US007763180B2

(12) United States Patent
Tanaka et al.

(10) Patent No.: US 7,763,180 B2
(45) Date of Patent: Jul. 27, 2010

(54) WRINKLE-REMOVING COMPOSITION

(75) Inventors: Atsushi Tanaka, Wakayama (JP); Isao Yamada, Wakayama (JP)

(73) Assignee: Kao Corporation, Tokyo (JP)

( * ) Notice: Subject to any disclaimer, the term of this patent is extended or adjusted under 35 U.S.C. 154(b) by 548 days.

(21) Appl. No.: 11/662,054

(22) PCT Filed: Sep. 7, 2005

(86) PCT No.: PCT/JP2005/016875

§ 371 (c)(1),
(2), (4) Date: Mar. 27, 2007

(87) PCT Pub. No.: WO2006/028261

PCT Pub. Date: Mar. 16, 2006

(65) Prior Publication Data

US 2008/0087861 A1 Apr. 17, 2008

(30) Foreign Application Priority Data

Sep. 7, 2004 (JP) ..... 2004-260045

(51) Int. Cl.

| | |
|---|---|
| ***D06M 15/53*** | (2006.01) |
| ***D06M 13/02*** | (2006.01) |
| ***D06M 13/144*** | (2006.01) |
| ***D06M 13/165*** | (2006.01) |
| ***D06M 13/188*** | (2006.01) |
| ***D06M 15/643*** | (2006.01) |

(52) U.S. Cl. ..... 252/8.91; 252/8.61; 427/387; 427/393.2; 427/421.1; 427/427.4; 427/427.6; 427/427.7

(58) Field of Classification Search ..... 252/8.61, 252/8.91; 427/387, 393.2, 421.1, 427.4, 427/427.6, 427.7
See application file for complete search history.

(56) References Cited

FOREIGN PATENT DOCUMENTS

| | | | | |
|---|---|---|---|---|
| EP | 1 380 628 | A1 | | 1/2004 |
| JP | 52-63496 | A | * | 5/1977 |
| JP | 64-6174 | A | | 1/1989 |
| JP | 10-25660 | A | | 1/1998 |
| JP | 10-508911 | A | | 9/1998 |
| JP | 10-298868 | A | | 11/1998 |
| JP | 2002-54074 | A | * | 2/2002 |
| JP | 2004-270076 | A | | 9/2004 |
| JP | 2004-324025 | A | | 11/2004 |
| WO | WO 99/55952 | A1 | | 11/1999 |
| WO | WO 99/55953 | A1 | | 11/1999 |

OTHER PUBLICATIONS

Partial translation of JP 10-25660, published on Jan. 27, 1998.
Partial translation of JP 10-298868, published on Nov. 10, 1998.

* cited by examiner

*Primary Examiner*—Anthony J Green
(74) *Attorney, Agent, or Firm*—Birch, Stewart, Kolasch & Birch, LLP

(57) ABSTRACT

The present invention provides a wrinkle-removing composition capable of removing wrinkles in fiber products without deteriorating the texture, even if heat treatment such as ironing and steam pressing is not carried out. The present relates to a wrinkle-removing composition containing an alkylene oxide adduct (a) represented by a specific general formula (1) or a general formula (2) or (3), as well as a method of removing wrinkles in fiber products, which includes applying the wrinkle-removing composition onto fiber products.

10 Claims, No Drawings

WRINKLE-REMOVING COMPOSITION

FIELD OF THE INVENTION

The present invention relates to a wrinkle-removing composition and a wrinkle-removing method capable of removing wrinkles in fiber products, which can effectively remove wrinkles without deteriorating the texture, without particularly conducting heat treatment such as ironing.

BACKGROUND OF THE INVENTION

Generally, washing of clothes for dry cleaning, such as suits, is difficult in the home, and as a method of removing wrinkles therefrom, there is generally a method of heat treatment such as ironing and steam pressing. As a means of smoothing out wrinkles in clothes without heat treatment, JP-A 10-25660 discloses a method of removing wrinkled portions, which includes spraying wrinkled portions of clothes with a composition containing a specific water-soluble solvent such as hexylene glycol and isoprene glycol combined with water and merely leaving the clothes to remove the wrinkled portions. In this method, slight wrinkles in clothes can be removed, but complete removal of deep wrinkles is difficult. Also, JP-A (W) 10-508911, WO-A 99/55952, WO-A 99/55953 and JP-A 1-6174 disclose compositions and methods for removing wrinkles in textile fabrics. In these methods, textile fabrics are sprayed with a composition and then hung to let them naturally dried, wherein ironing is conducted to remove wrinkles, but wrinkles cannot be sufficiently removed by mere natural drying; ironing is very effective at removing wrinkles, but is troublesome work and insufficient for recovering the texture.

SUMMARY OF THE INVENTION

The present invention provides a wrinkle-removing composition containing a compound (a) represented by the following general formula (1), (2) or (3):

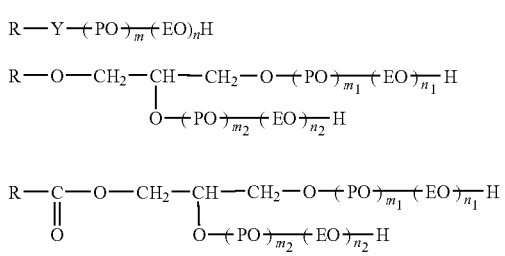

(1)

(2)

(3)

wherein R is a hydrocarbon group having 10 to 22 carbon atoms, EO represents $C_2H_4O$, PO represents $C_3H_6O$, m and n each represent a number of moles added on the average, in is a number of 3 to 100, n is a number of 1 to 10, (PO) and (EO) may be added in a random or block form, and the order in which (PO) and (EO) are added is not limited; m1 and m2 each represent the number of moles added on the average, the sum of m1 and m2 is 3 to 100, n1 and n2 each represent the number of moles added on the average, the sum of n1 and n2 is 1 to 10, (PO) and (EO) may be added in a random or block form, and the order in which (PO) and (EO) are added is not limited; and Y represents;

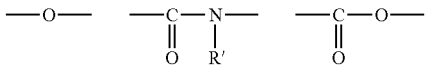

wherein R' represents a hydrogen atom or a hydrocarbon group having 1 to 3 carbon atoms.

Further, the present invention provides a method of removing wrinkles in fiber products which includes applying the above wrinkle-removing composition onto fiber products, as well as use of the above composition in removing wrinkles in fiber products.

DETAILED DESCRIPTION OF THE INVENTION

The present invention provides a wrinkle-removing composition and a wrinkle-removing method, which can sufficiently remove wrinkles in fiber products without deteriorating the texture, even if heat treatment such as ironing and steam pressing is not carried out.

The wrinkle-removing composition of the present invention can easily remove wrinkles in fiber products by merely spraying onto the fiber products and can remove wrinkles in fiber products effectively without deteriorating the texture, without particularly conducting heat treatment such as ironing and steam pressing. The component (a) according to the present invention is amphiphilic and can thus be easily removed in washing after wearing and use of fiber products after treatment, or in washing with a usual aqueous medium or in dry cleaning with an organic solvent.

<Component (a)>

In the general formula (1), (2) or (3) for the component (a), R is a hydrocarbon group having 10 to 22 carbon atoms, preferably an alkyl group having 12 to 18 carbon atoms or an alkenyl group having 12 to 18 carbon atoms. R is more preferably an alkyl group having 16 to 18 carbon atoms.

The number of moles of propylene oxide ($C_3H_6O$ group, hereinafter referred to sometimes as PO) added on the average, that is, m or m1+m2, is a number of 3 to 100, preferably 3 to 60, even more preferably 10 to 60. m1 and m2 each represent a number of greater than 0.

The number of moles of ethylene oxide ($C_2H_4O$ group, hereinafter referred to sometimes as EO) added on the average, that is, n or n1+n2, is a number of 1 to 10, preferably 1 to 8, even more preferably 1 to 3. n1 and n2 each represent a number of greater than 0.

The molar ratio of PO/EO in the general formula (1), (2) or (3), that is, m/n or (m1+m2)/(n1+n2), is preferably 4 to 12, more preferably 6 to 10.

Preferably, the compound (a) also includes a compound represented by the general formula (1'):

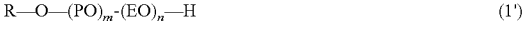

(1')

wherein R is a hydrocarbon group having 10 to 22 carbon atoms, EO represents $C_2H_4O$, PO represents $C_3H_6O$, m and n each represent a number of moles added on the average, m is a number of 3 to 100, n is a number of 1 to 10, (PO) and (EO) may be added in a random or block form, and the order in which (PO) and (EO) are added is not limited. Preferably, m is a number of 10 to 100 and n is a number of 3 to 10. The moles of PO or EO moles added on the average can be determined by NMR.

The component (a) in the present invention is obtained by adding PO and EO in a usual manner to ROH or a compound represented by:

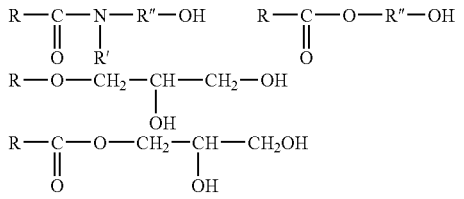

wherein R and R' have the same meanings as defined above, and R" is a divalent hydrocarbon group having 2 to 3 carbon atoms.

In the present invention, the compound to which PO and EO are added in the average added mole number of the specific range can be used to achieve an excellent wrinkle-removing effect without deteriorating the texture.

(PO) and (EO) may be added in a random or block form, and the order in which (PO) and (EO) are added is not limited and may include the order of (PO), (EO) and (PO).

<Component (b)>

Preferably the wrinkle-removing composition of the present invention contains an oily compound (b) [referred to hereinafter as component (b)] in order to further improve the wrinkle-removing effect. The component (b) is preferably at least one kind of oily compound selected from the following (b1) to (b7):

(b1) a saturated or unsaturated linear or branched hydrocarbon having an average molecular weight of 100 to 500;

(b2) a primary or secondary alcohol having an average molecular weight of 100 to 300;

(b3) an ester or ether compound represented by the following formula (I) or (II):

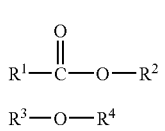

(I)

$R^3—O—R^4$ (II)

wherein R1 represents a saturated or unsaturated linear or branched monovalent hydrocarbon group having 8 to 20 carbon atoms, R2 represents a saturated or unsaturated linear or branched monovalent hydrocarbon group having 1 to 20 carbon atoms, and $R^3$ and $R^4$ independently represent a saturated or unsaturated linear or branched monovalent hydrocarbon group having 4 to 18 carbon atoms;

(b4) a fatty acid having an average molecular weight of 100 to 500;

(b5) a tri-, di- or mono-glyceride of a fatty acid having 12 to 24 carbon atoms;

(b6) squalane; and (b7) cholesterol.

The hydrocarbon (b1) is a saturated or unsaturated linear or branched hydrocarbon having an average molecular weight of 100 to 500, and includes, for example, a fraction based on paraffinic compounds separated and purified from petroleum, paraffinic oil such as liquid paraffin, etc. Among these compounds, liquid paraffin having an average molecular weight of 200 to 400 is preferable.

The primary or secondary alcohol (b2) having an average molecular weight of 100 to 300 includes a primary or secondary alcohol having 8 to 20 carbon atoms, preferably an alcohol having 14 to 20 carbon atoms.

The ester or ether compound (b3) represented by the formula (I) or (II) is an ester compound wherein $R^1$ is an alkyl or alkenyl group having 8 to 20 carbon atoms, $R^2$ is an alkyl group having 1 to 20 carbon atoms, or an ether compound wherein each of $R^3$ and $R^4$ is an alkyl group having 4 to 10 carbon atoms.

The fatty acid (b4) having an average molecular weight of 100 to 500 may be any of saturated or unsaturated linear or branched fatty acids. Specifically, the fatty acid (b4) includes C6 to C20 fatty acids, and is preferably hexanoic acid, octanoic acid or decanoic acid.

The fatty tri-, di- or monoglyceride (b5) having 12 to 24 carbon atoms includes tri- di- or monomyristin, tri-, di- or monostearin, tri-, di- or monoolein, tri, di- or monoerucin etc., preferably a saturated fatty glyceride such as tri-, di- or monomyristin or tri-, di- or monostearin, more preferably a triglyceride such as trimyristin or tristearin.

The component (b) is preferably at least one member selected from the components (b1) to (b3), more preferably the component (b1) or (b2), even more preferably the component (b1), particularly preferably liquid paraffin having an average molecular weight of 200 to 400.

<Component (c)>

The wrinkle-removing composition of the present invention preferably contains an emulsifying agent (c) [hereinafter referred to as component (c)] and water.

The component (c) that is an emulsifying agent includes nonionic surfactants such as polyoxyalkylene alkyl or alkenyl ether, polyoxyalkylene alkyl phenyl ether, fatty alkanol amide or alkylene oxide adducts thereof, sucrose fatty ester and alkyl glucoside; cationic surfactants such as mono-long-chain-alkyl quaternary ammonium salt, di-long-chain-alkyl quaternary ammonium salt and tri-long-chain-alkyl quaternary ammonium salt; anionic surfactants such as alkylbenzene sulfonate or salts thereof, alkyl sulfate, polyoxyalkylene alkyl ether sulfate, olefin sulfonate, alkane sulfonate and fatty acid salt; and amphoteric surfactants such as amine oxide, sulfobetaine and carbobetaine; and at least one member selected from a nonionic surfactant having an HLB (determined by the Griffin method; this applies hereinafter) of 4.0 to 15.0, a cationic surfactant having 1 to 3 monovalent hydrocarbon groups having 10 to 16 carbon atoms, and an anionic surfactant having a monovalent hydrocarbon group having 6 to 14 carbon atoms.

The emulsifying agent in the present invention is particularly preferably a nonionic surfactant represented by the general formula (III):

$$R^5—O—(R^6O)_p—H \quad (III)$$

wherein $R^5$ is a linear or branched alkyl or alkenyl group having 8 to 22 carbon atoms, preferably 10 to 20 carbon atoms, $R^6$ is an alkylene group having 2 carbon atoms, that is, an ethylene group; p is a number of 0.5 to 30, preferably 2 to 20, more preferably 4 to 10, which is indicative of the number of moles added on the average.

The compound represented by the general formula (III) is for example a compound represented by the following formula (IV):

$$R_7—O—(C_2H_4O)_r—H \quad (IV)$$

wherein $R^7$ represents a linear or branched alkyl group having 10 to 18 carbon atoms, r is a number of 1 to 10, preferably 3 to 8, which is indicative of the number of moles added on the average.

<Component (d)>

The wrinkle-removing composition of the present invention preferably contains a silicone compound (d) [referred to hereinafter as component (d)].

The component (d) that is a silicone compound is particularly preferably a compound usable as a lubricant for fibers. Specific examples include dimethyl polysiloxane (hereinafter referred to as dimethyl silicone), an organopolysiloxane containing dimethyl silicone wherein a part of methyl groups in side chains or terminals thereof are converted into hydroxyl groups (hereinafter referred to as hydroxy silicone), an organopolysiloxane containing the above dimethyl silicone or hydroxy silicone wherein a part of methyl groups (preferably methyl groups in side chains) are converted into organic groups other than methyl groups (hereinafter referred to as modified silicone), an organopolysiloxane containing dimethyl siloxane having an organic group introduced into a chain thereof with a terminal having an organic group other than a methyl group (hereinafter referred to as terminal-modified silicone), etc.

In the modified silicone, the organic group other than a methyl group includes an organic group containing an amino group, an organic group containing a quaternary ammonium group, an organic group containing an amide group, an organic group containing a polyether group, an organic group containing an epoxy group, an organic group containing a carboxy group, an organic group containing an alkyl group, an organic group containing a halogenoalkyl group, halogenoalkylene group or halogenoaryl group, an organic group containing a poly(N-acylalkyleneimine) chain, etc.

Among these silicone compounds, a silicone compound called silicone oil, which is liquid at a temperature of 0 to 40° C., is preferable.

[Wrinkle-Removing Composition]

The wrinkle-removing composition of the present invention is a composition containing the component (a) and if necessary the component (b), the component (c), the component (d), and water, and can be formed into a composition of O/W emulsion type. The average particle diameter of emulsified liquid droplets in the composition of O/W emulsion type is preferably 0.1 to 10 μm, more preferably 0.1 to 3 μm, from the viewpoint of a uniform application of the component (a) on fiber in as small an amount as possible and thereby reducing the transpiration rate of water to suppress wrinkling and simultaneously suppressing staining with an oil solution.

In the present invention, the average particle diameter of emulsified liquid droplets can be measured by a dynamic light scattering photometer (ELS-800 manufactured by Otsuka Electronics Co., Ltd.).

The content of the component (a) in the wrinkle-removing composition of the present invention is preferably 0.1 to 5 wt %, more preferably 0.2 to 4 wt %, even more preferably 0.2 to 2 wt %, from the viewpoint of the wrinkle-removing effect and the solution stability of the blended composition.

The content of the component (b) in the wrinkle-removing composition of the present invention is preferably 0.01 to 10 wt %, more preferably 0.05 to 2.0 wt %, even more preferably 0.01 to 0.5 wt %, from the viewpoint of reducing the transpiration rate of water to reduce the drying rate thereby suppressing generation of wrinkles. The content of the component (c) is preferably 0.01 to 20 wt %, more preferably 0.1 to 10 wt %, even more preferably 0.2 to 1.0 wt %, from the viewpoint of efficiently emulsifying not only the component (a) but also the component (b).

For improving an ability of fibers to slide on one another in clothes in a dried state, the composition of the present invention preferably contains the component (d), wherein the content of the component (d) is preferably 0.02 to 3.0 wt %, more preferably 0.1 to 0.5 wt %.

The wrinkle-removing composition of the present invention can be compounded with a perfume, a bactericide, an antiseptic etc. in addition to the component (a) as well as the components (b) to (d).

Although the method of producing a wrinkle-removing composition of O/W emulsion type as the composition of the present invention is not particularly limited, the composition of O/W emulsion type can be obtained for example by mixing the above respective components with water and stirring them with a homomixer etc. such that the average size of the resulting emulsified liquid droplets become 0.1 to 10 μm.

[Method of Removing Wrinkles]

The method of removing wrinkles according to the present invention is a method of removing wrinkles in fiber products by applying the wrinkle-removing composition of the present invention as described above onto fiber products, and can remove wrinkles without heat treatment such as ironing and steam pressing. If necessary, heat treatment may be carried out.

The method of applying the wrinkle-removing composition of the present invention onto fiber products is preferably a spray method wherein the wrinkle-removing composition of the present invention is charged preferably into a container equipped with a spray device by which the composition is sprayed onto fiber products. The spray device is preferably a trigger-type device, and particularly a trigger of accumulator type excellent in spray uniformity without liquid dripping, as shown in FIG. 1 in JP-A (U) 4-37554, can be preferably used.

EXAMPLES

The Examples below describe the practice of the present invention. The Examples are merely illustrative of the present invention and are not intended to limit the present invention.

Examples 1 to 18 and Comparative Examples 1 to 8

The components shown below were used in the ratios shown in Table 1, as follows: The component (c) was mixed with the components (a) and (b), and the same weight of water as that of the component (b) was mixed therewith and stirred at 400 rpm for 10 minutes with a homomixer. After stirring, the rest of the components and water were added, and the mixture was stirred at 3000 rpm for 10 minutes to afford each wrinkle-removing composition. The resulting composition was evaluated for its wrinkle-removing property by the following method. The evaluation results are shown in Table 1.

<Compounding Components>

(a-1): Compound represented by the general formula (1') wherein R is a linear alkyl group having 18 carbon atoms, m is 38, and n is 6, that is, $C_{18}$—O—$(PO)_{38}$-$(EO)_6$—H in terms of the number of carbon atoms in the alkyl group and the numbers of moles of PO and EO added.

(a-2): Compound represented by the general formula (1') wherein R is a linear alkyl group having 16 carbon atoms, m is 15, and n is 3, that is, $C_{16}$—O—$(PO)_{15}$-$(EO)_3$—H.

(a-3): Compound represented by the general formula (1') wherein R is a linear alkyl group having 12 carbon atoms, m is 25, and n is 3, that is, $C_{12}$—O—$(PO)_{25}$-$(EO)_3$—H.

(a-4): Compound represented by the general formula (1') wherein R is a linear alkyl group having 18 carbon atoms, m is 38, and n is 6, that is, $C_{18}$—O-$(EO)_6$—$(PO)_{38}$—H.

(a-5): Compound represented by the general formula (1') wherein R is a linear alkyl group having 18 carbon atoms, m is 20, and n is 5, that is, $C_{18}$—O—$(PO)_{10}$-$(EO)_5$—$(PO)_{10}$—H.

(a-6): Compound represented by the general formula (1') wherein R is a linear alkyl group having 18 carbon atoms, m is 30, and n is 5, that is, $C_{18}$—O—$(PO)_{10}$-$(EO)_5$—$(PO)_{90}$—H.

(a-7): Compound represented by the general formula (1') wherein R is a linear alkyl group having 18 carbon atoms, m is 55, and n is 2, that is, $C_{18}$—O-$(EO)_2$—$(PO)_{55}$—H.

(a-8): Compound represented by the general formula (1') wherein R is a linear alkyl group having 18 carbon atoms, m is 3, and n is 1, that is, $C_{18}$—O-$(EO)_1$—$(PO)_3$—H.

(a-9): Compound represented by the general formula (1') wherein R is a linear alkyl group having 18 carbon atoms, m is 3, and n is 3, that is, $C_{18}$—O-$(EO)_3$—$(PO)_3$—H.

(a-10): Compound represented by the general formula (1') wherein R is a linear alkyl group having 18 carbon atoms, m is 10, and n is 5, that is, $C_{18}$—O—$(PO)_{10}$-$(EO)_5$—H.

(a-11): Compound represented by the general formula (1') wherein R is a linear alkyl group having 18 carbon atoms, m is 15, and n is 5, that is, $C_{18}$—O—$(O)_{10}$-$(EO)_5$—$(PO)_5$—H.

(a-12): Compound represented by the general formula (1') wherein R is a linear alkyl group having 20 carbon atoms, m is 15, and n is 7, that is, $C_{20}$—O-$(EO)_7$—$(PO)_{15}$—H.

(a'-1): Compound represented by the general formula (1') wherein R is a linear alkyl group having 12 carbon atoms, m is 12, and n is 12, that is, $C_{12}$—O—$(PO)_{12}$-$(EO)_{12}$—H.

(a'-2): Compound represented by the general formula (1') wherein R is a linear alkyl group having 12 carbon atoms, m is 0, and n is 8, that is, $C_{12}$—O-$(EO)_8$—H.

(a'-3): Compound represented by the general formula (1') wherein R is a linear alkyl group having 18 carbon atoms, m is 0, and n is 30, that is, $C_{18}$—O-$(EO)_{30}$—H.

(a'-4): Compound represented by the general formula (1') wherein R is a linear alkyl group having 18 carbon atoms, m is 20, and n is 20, that is, $C_{18}$—O-$(EO)_{20}$—$(PO)_{20}$—H.

(a'-5): Compound represented by the general formula (1') wherein R is a linear alkyl group having 18 carbon atoms, m is 18, and n is 32, that is, $C_{18}$—O-$(EO)_3$—$(PO)_3$-$(EO)_{29}$—$(PO)_{15}$—H.

(a'-6): Compound represented by the general formula (1') wherein R is a linear alkyl group having 18 carbon atoms, m is 23, and n is 30, that is, $C_{18}$—O-$(EO)_6$—$(PO)_3$-$(EO)_{24}$—$(PO)_{20}$—H.

(b-1): Liquid paraffin (Moresco White P-55, average molecular weight 296, manufactured by Matsumura Oil Co., Ltd.).

(b-2): Cetyl alcohol, reagent (manufactured by Wako Pure Chemical Industries, Ltd.).

(c-1): Nonionic surfactant (HLB 10.8) having 5 moles on the average of EO added to a linear primary alcohol having 10 to 14 carbon atoms.

(d-1): Silicone compound (1): LE-463 (emulsion of dimethyl polysiloxane, manufactured by Nippon Unicar Co., Ltd.).

(d-2): Silicone compound (2): ABN SILWET FZ-2203 (dimethyl polysiloxane/polyalkylene oxide copolymer, manufactured by Nippon Unicar Co., Ltd.).

<Method of Evaluating Removal of Wrinkle>

(1) Evaluation of Wrinkle-Removing Property of Spray

A test cloth 20×10 cm made of cotton broad cloth #60 (staining test material, Yato Shoten Co., Ltd.) or a wool fabric (wool serge, Yato Shoten Co., Ltd.) was moistened by spraying with deionized water and then folded in two, and after the folded portion was loaded with a weight of 2 kg in a thermostatic chamber set at 40° C., the test cloth was left in such a state for 24 hours, thereby providing the test cloth with a wrinkle which was then used as a model wrinkle for evaluating wrinkle removal.

The test cloth with the model wrinkle was sprayed by a spray device (T-7500, manufactured by Canyon Corporation) with the wrinkle-removing composition in an amount of 50 wt % based on the dry weight of the test cloth and then left for 12 hours in a thermostatic chamber at 25° C./50% RH, thereby air-drying it. After drying was finished, the degree of removal of the wrinkle from the test cloth was judged.

In the judgment, the cloth treated by spraying with the wrinkle-removing composition and the cloth (control) before the treatment were scored respectively by a panel of 5 persons by the following criteria to determine the average as score.

Criteria for Judgment of Wrinkle

5: There is no wrinkle.

4: There is little wrinkle.

3: The wrinkle slightly remains.

2: The wrinkle fairly remains.

1: The wrinkle significantly remains.

TABLE 1

| | | Example | | | | | | | | | | | | | |
|---|---|---|---|---|---|---|---|---|---|---|---|---|---|---|---|
| | | 1 | 2 | 3 | 4 | 5 | 6 | 7 | 8 | 9 | 10 | 11 | 12 | 13 | 14 |
| Composition (weight-%) | (a-1) | 5.0 | 0.2 | | | | | | | | | | | | 0.2 |
| | (a-2) | | | 0.2 | | | | | | | | | | | |
| | (a-3) | | | | 0.2 | | | | | | | | | | |
| | (a-4) | | | | | 0.2 | | | | | | | | | |
| | (a-5) | | | | | | 0.2 | | | | | | | | |
| | (a-6) | | | | | | | 0.2 | | | | | | | |

TABLE 1-continued

| | | | | | | | | | | | | | | |
|---|---|---|---|---|---|---|---|---|---|---|---|---|---|---|
| (a-7) | | | | | | | | 0.2 | | | | | | |
| (a-8) | | | | | | | | | 0.2 | | | | | |
| (a-9) | | | | | | | | | | 0.2 | | | | |
| (a-10) | | | | | | | | | | | 0.2 | | | |
| (a-11) | | | | | | | | | | | | 0.2 | | |
| (a-12) | | | | | | | | | | | | | 0.2 | |
| (a'-1) | | | | | | | | | | | | | | |
| (a'-2) | | | | | | | | | | | | | | |
| (a'-3) | | | | | | | | | | | | | | |
| (a'-4) | | | | | | | | | | | | | | |
| (a'-5) | | | | | | | | | | | | | | |
| (a'-6) | | | | | | | | | | | | | | |
| (b-1) | 0.1 | 0.1 | 0.1 | 0.1 | 0.1 | 0.1 | 0.1 | 0.1 | 0.1 | 0.1 | 0.1 | 0.1 | 0.1 | |
| (b-2) | | | | | | | | | | | | | | 0.1 |
| (c-1) Nonionic surfactant | 0.2 | 0.2 | 0.2 | 0.2 | 0.2 | 0.2 | 0.2 | 0.2 | 0.2 | 0.2 | 0.2 | 0.2 | 0.2 | 0.2 |
| (d-1) Silicone compound(1) | | | | | | | | | | | | | | |
| (d-2) Silicone compound(2) | | | | | | | | | | | | | | |
| Ethanol | 2.0 | 2.0 | 2.0 | 2.0 | 2.0 | 2.0 | 2.0 | 2.0 | 2.0 | 2.0 | 2.0 | 2.0 | 2.0 | 2.0 |
| Water | balance | balance | balance | balance | balance | balance | balance | balance | balance | balance | balance | balance | balance | balance |
| Total | 100 | 100 | 100 | 100 | 100 | 100 | 100 | 100 | 100 | 100 | 100 | 100 | 100 | 100 |
| Evaluation of removal of wrinkle by spray (cotton) | 4.0 | 4.0 | 4.0 | 3.5 | 3.5 | 3.5 | 4.0 | 4.0 | 3.4 | 3.4 | 3.4 | 3.2 | 3.4 | 4.0 |
| Evaluation of removal of wrinkle by spray (wool) | 4.5 | 4.0 | 3.5 | 3.5 | 3.5 | 3.5 | 3.5 | 4.0 | 3.4 | 3.4 | 3.2 | 3.2 | 3.2 | 3.5 |

| | | Example | | | | Comparative example | | | | | | | |
|---|---|---|---|---|---|---|---|---|---|---|---|---|---|
| | | 15 | 16 | 17 | 18 | 1 | 2 | 3 | 4 | 5 | 6 | 7 | 8 |
| Composition (weight-%) | (a-1) | 0.2 | 0.2 | 0.2 | 0.2 | | | | | | | | |
| | (a-2) | | | | | | | | | | | | |
| | (a-3) | | | | | | | | | | | | |
| | (a-4) | | | | | | | | | | | | |
| | (a-5) | | | | | | | | | | | | |
| | (a-6) | | | | | | | | | | | | |
| | (a-7) | | | | | | | | | | | | |
| | (a-8) | | | | | | | | | | | | |
| | (a-9) | | | | | | | | | | | | |
| | (a-10) | | | | | | | | | | | | |
| | (a-11) | | | | | | | | | | | | |
| | (a-12) | | | | | | | | | | | | |
| | (a'-1) | | | | | | 5.0 | 0.2 | | | | | |
| | (a'-2) | | | | | | | | 0.2 | | | | |
| | (a'-3) | | | | | | | | | 0.2 | | | |
| | (a'-4) | | | | | | | | | | 0.2 | | |
| | (a'-5) | | | | | | | | | | | 0.2 | |
| | (a'-6) | | | | | | | | | | | | 0.2 |
| | (b-1) | 0.1 | 0.1 | | | 0.1 | 0.1 | | 0.1 | 0.1 | 0.1 | 0.1 | 0.1 |
| | (b-2) | | | | | | | | | | | | |
| | (c-1) Non ionic surfactant | 0.2 | 0.2 | 0.2 | 0.2 | 0.2 | 0.2 | 0.2 | 0.2 | 0.2 | 0.2 | 0.2 | 0.2 |
| | (d-1) Silicone compound(1) | 0.1 | | 0.1 | | 0.5 | | | | | | | |
| | (d-2) Silicone compound(2) | | 0.1 | | | | | | | | | | |
| | Ethanol | 2.0 | 2.0 | 2.0 | 2.0 | 2.0 | 2.0 | 2.0 | 2.0 | 2.0 | 2.0 | 2.0 | 2.0 |
| | Water | balance | balance | balance | balance | balance | balance | balance | balance | balance | balance | balance | balance |
| | Total | 100 | 100 | 100 | 100 | 100 | 100 | 100 | 100 | 100 | 100 | 100 | 100 |
| Evaluation of removal of wrinkle by spray (cotton) | | 4.0 | 4.0 | 3.5 | 3.5 | 3.0 | 2.0 | 2.0 | 2.5 | 2.0 | 2.0 | 2.5 | 2.5 |
| Evaluation of removal of wrinkle by spray (wool) | | 4.0 | 4.0 | 3.5 | 3.5 | 3.0 | 2.5 | 2.5 | 2.5 | 2.0 | 2.5 | 2.5 | 2.5 |

The invention claimed is:

1. A wrinkle-removing composition comprising a compound (a), an oily compound (b), an emulsifying agent (c) and water, wherein compound (a) is represented by the following general formula (1), (2) or (3):

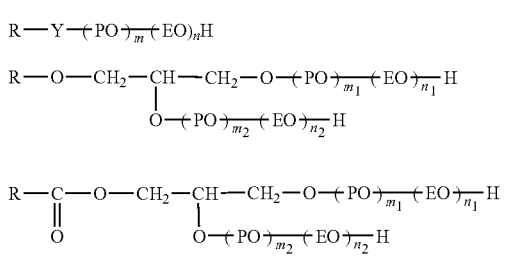

wherein R is a hydrocarbon group having 16 to 18 carbon atoms, EO represents $C_2H_4O$, PO represents $C_3H_6O$, m and n each represent a number of moles added on the average, m is a number of 3 to 100, n is a number of 1 to 10, (PO) and (EO) may be added in a random or block form, and the order in which (PO) and (EO) are added is not limited; m1 and m2 each represent the number of moles added on the average, the sum of m1 and m2 is 3 to 100, n1 and n2 each represent the number of moles added on the average, the sum of n1 and n2 is 1 to 10, (PO) and (EO) may be added in a random or block form, and the order in which (PO) and (EO) are added is not limited;

wherein the compound (a) is a compound wherein the molar ratio of m/n or (m1+m2)/(n1+n2) is 4 to 12; and Y represents one of the following:

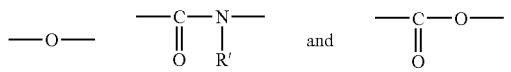

wherein R' represents a hydrogen atom or a hydrocarbon group having 1 to 3 carbon atoms;

wherein the oily compound (b) is at least one kind of oily compound selected from the following (b1) to (b7):

(b1) a saturated or unsaturated linear or branched hydrocarbon having an average molecular weight of 100 to 500;

(b2) a primary or secondary alcohol having an average molecular weight of 100 to 300;

(b3) an ester or ether compound represented by the following formula (I) or (II):

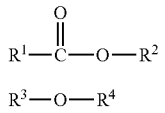

(I)

$R^3—O—R^4$ (II)

wherein $R^1$ represents a saturated or unsaturated linear or branched monovalent hydrocarbon group having 8 to 20 carbon atoms, $R^2$ represents a saturated or unsaturated linear or branched monovalent hydrocarbon group having 1 to 20 carbon atoms, and $R^3$ and $R^4$ independently represent a saturated or unsaturated linear or branched monovalent hydrocarbon group having 4 to 18 carbon atoms;

(b4) a fatty acid having an average molecular weight of 100 to 500;

(b5) a tri-, di- or mono-glyceride of a fatty acid having 12 to 24 carbon atoms;

(b6) squalane; and (b7) cholesterol.

2. The wrinkle-removing composition according to claim 1, wherein the compound (a) is a compound represented by the general formula (1) or (2) wherein R is an alkyl group having 16 to 18 carbon atoms, m or m1+m2 is a number of 3 to 60, and n or n1+n2 is a number of 1 to 8.

3. The wrinkle-removing composition according to claim 1, wherein the compound (a) is a compound represented by the general formula (1) or (2) wherein R is an alkyl group having 16 to 18 carbon atoms, m or m1+m2 is a number of 3 to 60, and n or n1+n2 is a number of 1 to 3.

4. The wrinkle-removing composition according to claim 1, which comprises the compound (a) in an amount of 0.1 to 5 wt %.

5. The wrinkle-removing composition according to claim 1, wherein the emulsifying agent (c) is at least one member selected from a nonionic surfactant having an HLB (Griffin method) of 4.0 to 15.0, a cationic surfactant having 1 to 3 monovalent hydrocarbon groups having 10 to 16 carbon atoms, and an anionic surfactant having a monovalent hydrocarbon group having 6 to 14 carbon atoms.

6. The wrinkle-removing composition according to claim 1, which further comprises a silicone compound (d).

7. A method of removing wrinkles in fiber products, which comprises applying the wrinkle-removing composition of claim 1 onto fiber products.

8. The method of removing wrinkles according to claim 7, wherein heat treatment is not carried out.

9. The method of removing wrinkles according to claim 7, wherein the method comprises spraying the wrinkle removing composition onto the fiber products.

10. The wrinkle-removing composition according to claim 1, wherein the compound (a) is a compound represented by the general formula (1'):

$$R—O—(PO)_m\text{-}(EO)_n—H \quad (1')$$

wherein R is a hydrocarbon group having 16 to 18 carbon atoms, EO represents $C_2H_4O$, PO represents $C_3H_6O$, m and n each represent a number of moles added on the average, m is a number of 3 to 100, n is a number of 1 to 10, (PO) and (EO) may be added in a random or block form, and the order in which (PO) and (EO) are added is not limited.

* * * * *